US011098434B2

(12) United States Patent
Byeon et al.

(10) Patent No.: US 11,098,434 B2
(45) Date of Patent: Aug. 24, 2021

(54) WASHING MACHINE

(71) Applicant: LG Electronics Inc., Seoul (KR)

(72) Inventors: Sangdeog Byeon, Seoul (KR); Hoon Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 223 days.

(21) Appl. No.: 16/204,937

(22) Filed: Nov. 29, 2018

(65) Prior Publication Data

US 2019/0161898 A1 May 30, 2019

(30) Foreign Application Priority Data

Nov. 29, 2017 (KR) ..... 10-2017-0162016

(51) Int. Cl.

| | |
|---|---|
| ***D06F 37/24*** | (2006.01) |
| ***D06F 39/10*** | (2006.01) |
| *D06F 37/12* | (2006.01) |
| *D06F 37/30* | (2020.01) |
| *D06F 23/04* | (2006.01) |

(52) U.S. Cl.

CPC ..... *D06F 37/24* (2013.01); *D06F 39/10* (2013.01); *D06F 23/04* (2013.01); *D06F 37/12* (2013.01); *D06F 37/30* (2013.01)

(58) Field of Classification Search

CPC ..... D06F 37/12; D06F 37/24; D06F 37/30; D06F 39/10; D06F 23/04

USPC ..... 68/13 R

See application file for complete search history.

(56) References Cited

U.S. PATENT DOCUMENTS

| | | | | |
|---|---|---|---|---|
| 2003/0131637 | A1 | 7/2003 | Lim et al. | |
| 2007/0163306 | A1* | 7/2007 | Kim ..... | H02K 1/2786 68/140 |

FOREIGN PATENT DOCUMENTS

| | | |
|---|---|---|
| JP | 2010022871 | 2/2010 |
| KR | 1020110025563 | 3/2011 |
| KR | 1020120027819 | 3/2012 |
| KR | 1020160123599 | 10/2016 |
| KR | 1020170057962 | 5/2017 |
| WO | WO2017034191 | 3/2017 |
| WO | WO2017061837 | 4/2017 |

OTHER PUBLICATIONS

WO2017061837A1—Machine translation (Year: 2017).*
KR20160126547A—Machine translation (Year: 2016).*
Australian Office Action in Australian Application No. 2018271352, dated Apr. 24, 2019, 11 pages.

* cited by examiner

*Primary Examiner* — Tinsae B Ayalew
(74) *Attorney, Agent, or Firm* — Fish & Richardson P.C.

(57) ABSTRACT

A washing machine comprises: an outer tub containing water; an inner tub rotating on a vertical axis within the outer tub and having a first opening at the bottom; a motor providing torque; a dewatering shaft rotating by the motor; and a hub supporting the inner tub from the bottom, wherein the hub comprises: a connecting boss whose center is connected to the dewatering shaft; a plurality of spokes extending outward radially from the connecting boss and having second openings overlapping the first opening; and a circular flange connecting the outer edges of the spokes and attached to the bottom of the inner tub, wherein the spokes comprise at least one first spoke whose underside faces the bottom of the outer tub and is entirely smooth.

20 Claims, 11 Drawing Sheets

WASHING MACHINE

CROSS-REFERENCE TO RELATED APPLICATIONS

This application claims the benefit of Korean Application No. 10-2017-0162016, filed on Nov. 29, 2017. The disclosure of the prior application is incorporated by reference in their entirety.

BACKGROUND OF THE INVENTION

Field of the Invention

The present invention relates to a washing machine in which an inner tub rotates on a vertical axis.

Related Art

Generally, a washing machine includes an outer tub that contains water and an inner tub that rotates within the outer tub. The washing machine is classified as a top-loading machine in which an inner tub with an open top rotates on a vertical axis or a front-loading machine in which an inner tub with an open front rotates on a horizontal axis.

The top-loading washing machine has a hub that connects a motor-driven rotating shaft and the inner tub. FIG. 13 shows the underside of a conventional hub. As shown in the drawing, the conventional hub includes a connecting boss 1310 at the center axially coupled to the rotating shaft and a plurality of spokes 1320 extending radially from the connecting boss 1310, with the outer edges of the spokes being connected by ring-shaped flanges 1330. The flanges 1330 are formed with a plurality of fastening holes 1331. Fastening members such as screws or bolts are put through the fastening holes 1331 and then secured to the inner tub.

Conventionally, the hub is made by die casting, and the cast material includes three ALDC types (classification according to KS specification number KS D 6006). However, due to insufficient strength of the three ALDC types, recesses 1321 are formed on the underside 525 of the spokes 1320 so that the spokes 1320 achieve strength by having an arch-shaped cross-section. However, impurities such as lint or dirt from laundry may build up in the recesses 1321 of the spokes 1320, causing sanitation problems.

Conventionally, a coating layer was formed on the surface of the hub by electrodeposition, in order to make up for the low corrosion resistance of the three ALDC types. However, the electrodeposition process may increase the total number of process steps for processing the hub, and by-products generated from the operation of electrodeposition coating facilities may cause environmental pollution problems.

Meanwhile, Korean Laid-Open Patent No. 10-2016-0126547 discloses a washing machine having a filter under a hub. When a centrifugal stream of water spreading out in a radial direction is generated within the inner tub by the rotation of a pulsator, the water in the outer tub runs through a filter and then enters the inner tub through an opening 1350 (see FIG. 13) formed in the hub. The filtering power of the filter is closely related to flow rate, so there is a need to optimize the area of the opening.

SUMMARY OF THE INVENTION

A first aspect of the present invention is to provide a washing machine that prevents a build up of impurities on the underside of a hub.

A second aspect of the present invention is to provide a washing machine that has a hub with sufficient strength even if spokes lack recesses.

A third aspect of the present invention is to provide a washing machine that has a higher flow rate of water entering an inner tub through the opening by increasing the area of the opening formed in the hub.

A fourth aspect of the present invention is to provide a washing machine that has a circulating water jet device for directing a centrifugal stream of water generated within the inner tub upward through a duct and spraying it back into the inner tub, the circulating water jet device including a filter for collecting lint floating in the stream of water, and that can increase the flow rate of water directed through the duct by improving the hub structure.

A fifth aspect of the present invention is to provide a washing machine that keeps the rigidity of the hub at a similar level to that in the conventional art and has a reduced weight.

A sixth aspect of the present invention is to provide a washing machine that can omit a coating process by making the hub using a highly corrosion-resistant material.

An exemplary embodiment of the present invention provides a washing machine comprising: an outer tub containing water; an inner tub rotating on a vertical axis within the outer tub and having a first opening at the bottom; a motor providing torque; a dewatering shaft rotating by the motor; and a hub supporting the inner tub from the bottom.

The hub comprises: a connecting boss whose center is connected to the dewatering shaft; a plurality of spokes extending outward radially from the connecting boss and having second openings overlapping the first opening; and a circular flange connecting the outer edges of the spokes and attached to the bottom of the inner tub.

The spokes comprise at least one first spoke whose underside faces the bottom of the outer tub and is entirely smooth.

The ratio between the sum of the overlapping areas between the second openings formed between the spokes and the first opening and the area of the first opening is 0.30 to 0.60.

The diameter of the first opening 19.5 to 21.5 cm, the diameter of the hub is 29.5 to 31.5 cm, and the ratio between the sum of the overlapping areas between the second openings and the first opening and the area of the first opening is 0.50 to 0.60.

The diameter of the first opening is 23.0 to 25.0 cm, the diameter of the hub is 35.5 to 36.5 cm, and the ratio between the sum of the overlapping areas between the second openings and the first opening and the area of the first opening is 0.35 to 0.45.

The first spokes have a cross-section whose top side is longer than the underside.

The first spokes are in the shape of a trapezoid whose top side is longer than the underside and whose vertices are chamfered into curves. The spokes comprise at least one second spoke which is basically the same shape as the first spokes and including recesses from the underside and coupling projections protruding from the bottom of the recesses. The second spokes extend further in a circumferential direction than the portion located outside the recesses.

The first spokes and the second spokes are arranged alternately around the circumference.

A cross-section of the second spokes has a convex profile in areas other than the recesses.

The hub comprises: a cylindrical first portion whose inner circumference engages with the dewatering shaft; and a second portion extending outward from the first portion and connecting between the spokes, wherein each spoke comprises: outer portions formed outside the connecting boss; and inner portions protruding from the underside of the second portion.

The hub further comprises circular ribs protruding from the underside of the second portion on the outer circumference of the second portion, wherein the circular ribs correspond in shape to the underside of the spokes to form a single surface with no irregularities.

The hub further comprises ribs protruding from the top side of the second portion and extending along the circumference outside the first portion.

The flange comprises: a rim portion interconnecting the spokes; and a plurality of fastening bosses corresponding to the spokes and placed further outward than the spokes and spaced apart from the spokes by a gap; and an outer circumferential ribs that protrude from the underside of the rim portion, connect the outer edges of the spokes together, extend along a given circumference, run inward from the circumference in the areas where the fastening bosses are located, and be connected to the outer edges of the spokes within the gap.

Cross-sections of the first spokes are analogous to each other, and the areas of the cross-sections become smaller toward the inside along the radius.

The washing machine further comprises: a pulsator rotatably provided within the inner tub; a circulating duct for directing a stream of water centrifugally forced by the pulsator upward; a filter placed in the circulating duct and filtering the stream of water; and nozzles placed on the inside of the inner tub and dispensing the stream of water filtered by the filter into the inner tub.

The washing machine further comprises: a filter placed under the hub and filtering a stream of water flowing into the second openings when the pulsator rotates, wherein the filter comprises: a filter frame configured in such a way that a plurality of water stream pass-through holes through which the stream of water passes overlaps the first opening; and a filter screen fixed to the filter frame and filtering the stream of water passing through the water stream pass-through holes.

A cross-section of the first spokes has a convex profile.

The hub is formed from six ALDC type materials.

DESCRIPTION OF EXEMPLARY EMBODIMENTS

Figure 1:
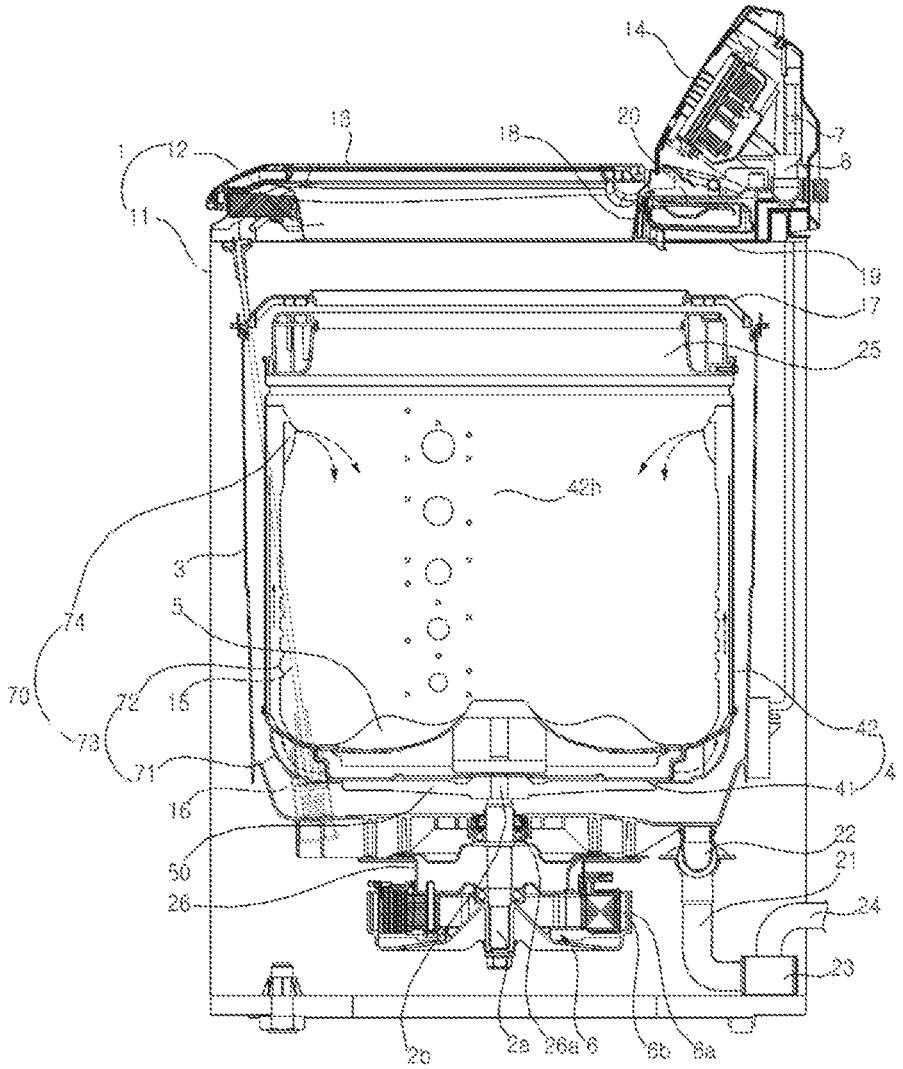
FIG. 1 is a side cross-sectional view of a washing machine according to an exemplary embodiment of the present invention.

The above and other objects, features and other advantages of the present invention will be more clearly understood from the following detailed description taken in conjunction with the accompanying drawings, in which:

Advantages and features of the present invention and methods for achieving them will be made clear from embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is merely defined by the scope of the claims. Therefore, well-known constituent elements, operations and techniques are not described in detail in the embodiments in order to prevent the present invention from being obscurely interpreted. Like reference numerals refer to like elements throughout the specification.

Figure 2:
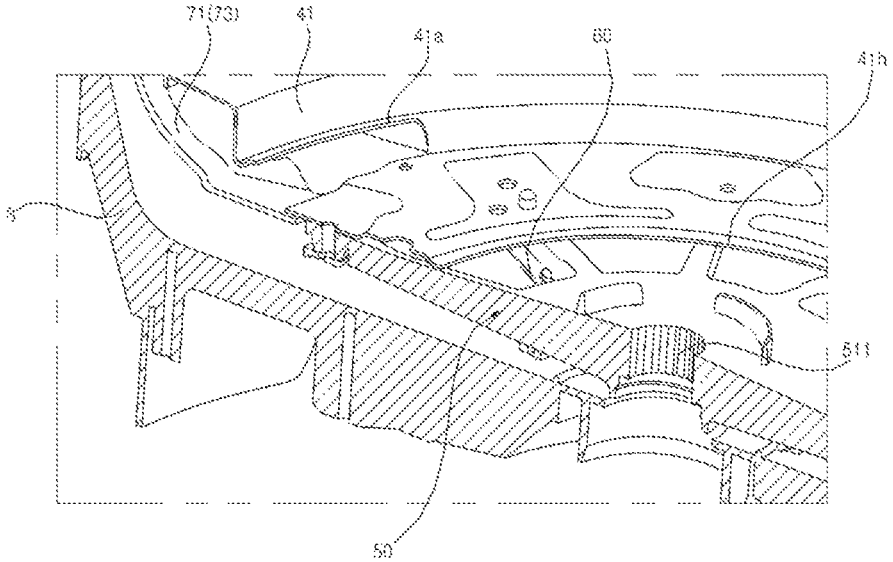
FIG. 2 is an enlarged view of the portion A of FIG. 1.
Figure 3:
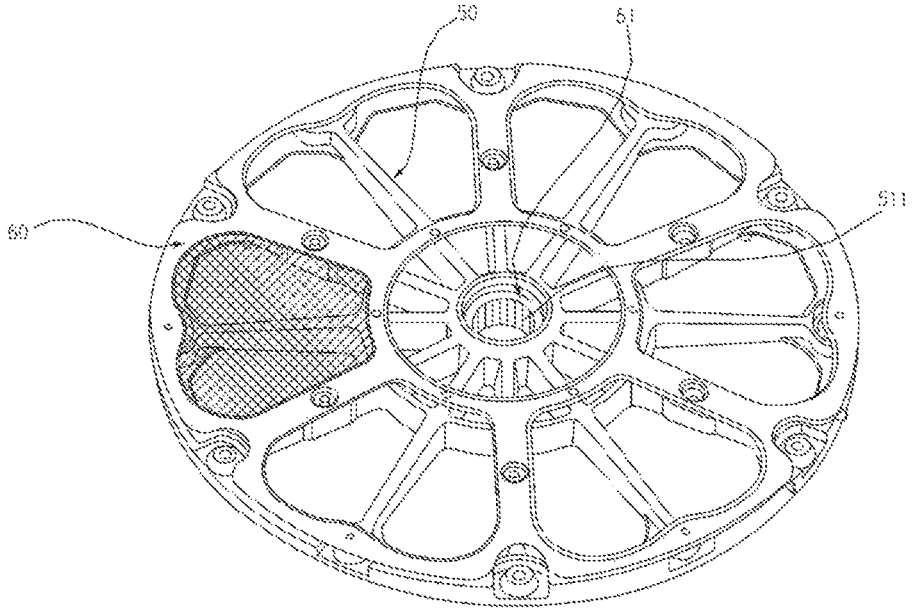
FIG. 3 shows an assembly of a hub and a lower filter.
Figure 4:
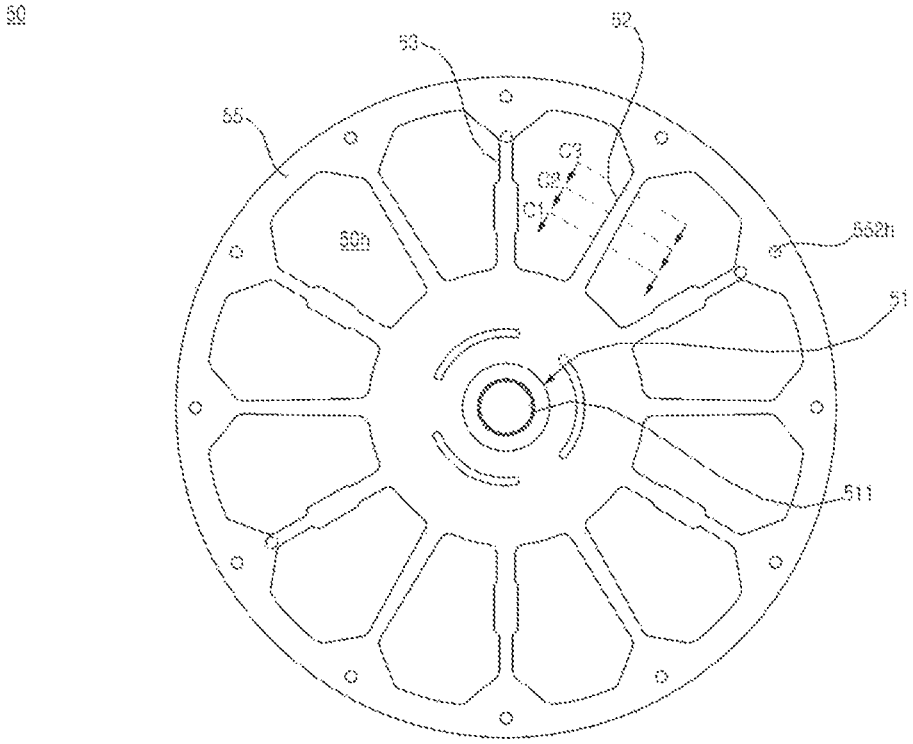
FIG. 4 is a top plan view of the hub.
Figure 5:
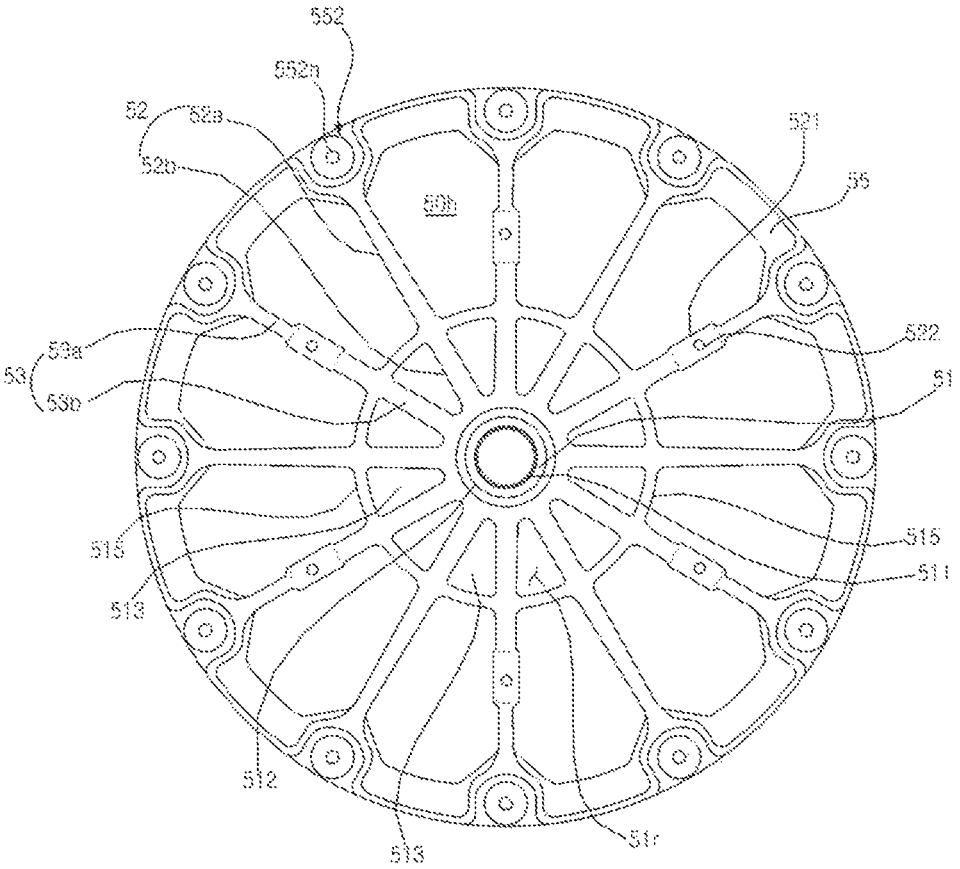
FIG. 5 is a bottom view of the hub.
Figure 6:
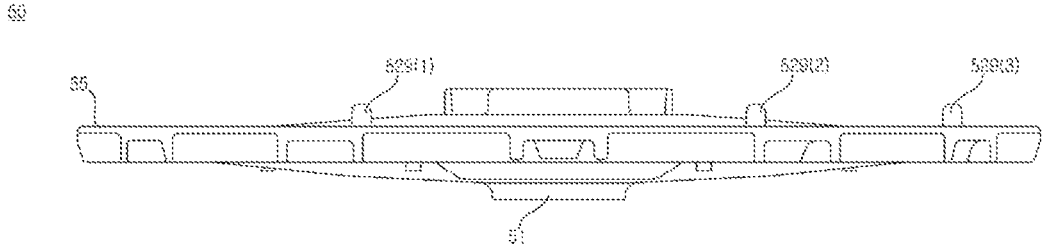
FIG. 6 is a side view of the hub.
Figure 7:
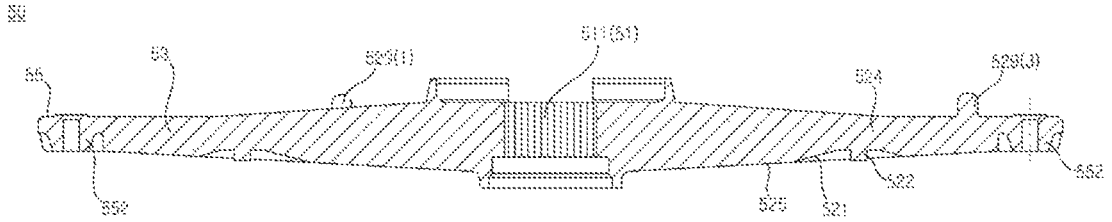
FIG. 7 is a cross-sectional view of the hub shown in FIG. 6.
Figure 8:
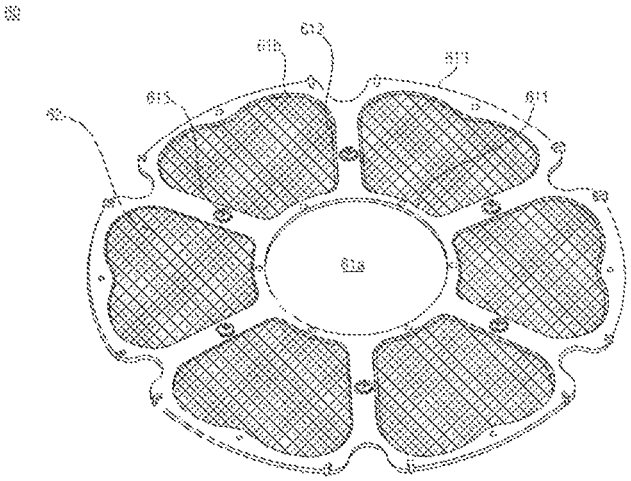
FIG. 8 is a perspective view of a filter frame.
Figure 9:
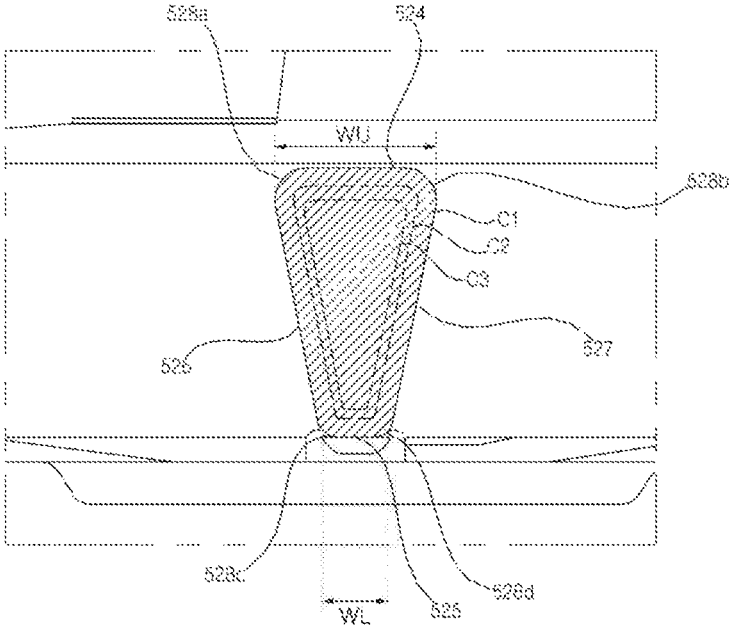
FIG. 9 is a cross-sectional view taken along C1 to C3 of FIG. 4.
Figure 10:
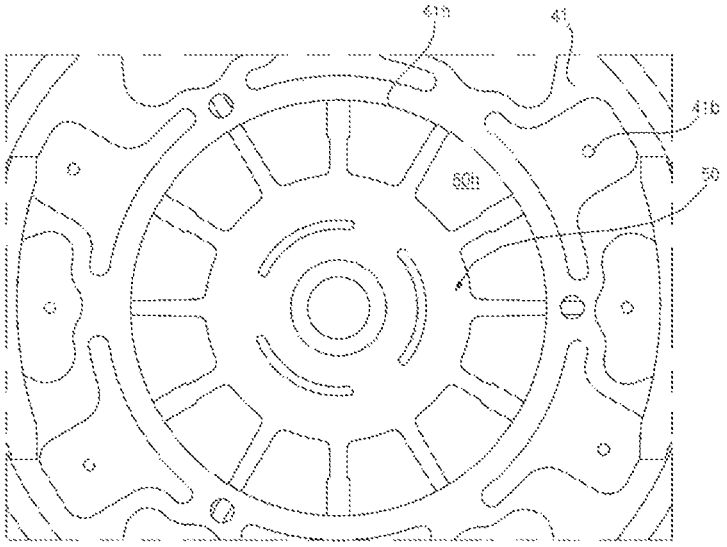
FIG. 10 shows the bottom of the inner tub when viewed from the top.

FIG. 1 is a side cross-sectional view of a washing machine according to an exemplary embodiment of the present invention. FIG. 2 is an enlarged view of the portion A of FIG. 1. FIG. 3 shows an assembly of a hub and a lower filter. FIG. 4 is a top plan view of the hub. FIG. 5 is a bottom view of the hub. FIG. 6 is a side view of the hub. FIG. 7 is a cross-sectional view of the hub shown in FIG. 6. FIG. 8 is a perspective view of a filter frame. FIG. 9 is a cross-sectional view taken along C1 to C3 of FIG. 4. FIG. 10 shows the bottom of the inner tub when viewed from the top.

Referring to FIGS. 1 through 10, a washing machine according to an exemplary embodiment of the present invention may include a casing 1 that forms the exterior and forms an internal space for containing an outer tub 3.

The casing 1 may include a cabinet 11 with an open top and a top cover 12 attached to the open top of the cabinet 1 and having a loading opening approximately at the center through which laundry is put. A door 13 for opening or shutting the loading opening may be rotatably attached to the top cover 12.

A control panel 14 is provided on the top cover 12, and may have an input part (e.g., buttons, dials, a touchpad, etc.) for receiving various control commands for controlling the operation of a laundry treatment machine from the user and a display part (e.g., LCD or LED display, etc.) for visually displaying the operational status of the laundry treatment machine.

The outer tub 3 is for containing water, and may be suspended within the casing 1 by supporting rods 15. The supporting rods 15 may be respectively connected to four corners of the top cover 12. Each supporting rod 15 may be connected to the outer tub 3 by a suspension 16 for damp out vibration.

The outer tub 3 has an open top, and an outer tub cover 17 may be provided on the open top. The center of the outer tub cover 17 may be shaped like an open ring to put laundry or take it out.

A water supply pipe 7 may be provided to direct water supplied from an external water source such as a faucet, and a water supply valve 8 may be provided to control the water supply pipe 7.

A drawer 18 for adding detergent may be placed in a drawer housing 19 in such a way as to be pulled out and pushed in. The drawer 18 provides separate spaces for storing different types of detergent. For example, the drawer 18 may provide spaces in which laundry detergent, fabric softener, bleach, and any other additives are stored without being mixed.

Furthermore, a dispenser 20 may be provided to selectively dispense the water supplied through the water supply pipe 7 into the spaces of the drawer 18. The water dispensed from the dispenser 20 is mixed with detergent as it passes through the drawer 18, and then pumped into the outer tub 3 or inner tub 4 through an outlet (not shown) formed in the drawer housing 19.

A drain bellows 21 for pumping water out of the outer tub 3 and a drain valve 22 for controlling the drain bellows 21 may be provided. The drain bellows 21 may be connected to a pump 23, and water may be supplied to the pump 23 through the drain bellows 21 when the drain valve 22 is opened. When the pump 23 is operated, the water introduced into the pump 23 is pumped out of the laundry treatment machine through a drain hose 24.

An inner tub 4 for containing laundry that rotates on a vertical axis may be located within the outer tub 3. A first opening 41*h* is formed in the bottom of the inner tub 4. More specifically, the inner tub 4 may include an inner tub base 41 with a first opening 41*h* and a cylindrical drum 42 whose bottom is attached to the inner tub base 41. The drum 42 may be formed with a plurality of through holes 42*h*, and water may be exchanged between the outer tub 3 and the inner tub 4 through the through holes 42*h*. Metal is a suitable material for the inner tub 4, and the inner tub 4 may be preferably made of, but not limited to, aluminum.

A balancer 25 for correcting eccentricity caused by the rotation of the inner tub 4 may be provided on the top of the drum 42. The balancer 25 is a ring-shaped space filled with a fluid or mass. When the inner tub 4 leans to one side, the fluid or mass is moved to the other side, thereby correcting eccentricity (or unbalance).

The pulsator 5 may be rotatably provided within the inner tub 4. The motor 6 provides force for rotating the pulsator 5 and the inner tub 4. Preferably, the motor 6 may rotate forward and backward, but not necessarily limited to it. The motor 6 may be a BLDC (brushless direct current electric motor), but not necessarily limited to it.

The motor 6 is an outer rotor motor in which a stator (not shown) with induction coil windings is placed at the center and a rotor 6*a* rotates around the stator. An inner shaft 2*a* is attached to the rotor 6*a*. A plurality of magnets 6*b* are arranged on the inner circumference of the rotor 6*a*, and the rotor 6*a* rotates due to a magnetic field interaction between the stator and the magnets.

An outer shaft 2*b* may have a hollow tubular shape. The inner shaft 2*a* may be inserted into the hollow. A pass-through slot may be formed in the bottom of the outer tub 3 through which the outer shaft 2*b* may pass.

A bearing housing 26 may be placed under the outer tub 3. The bearing housing 26 may be attached to the underside of the outer tub 3. A bearing 26*a* may be provided in the bearing housing 26 to support the outer shaft 2*b*.

A hub 50 may be provided under the inner tub 3 and attached to an inner tub base 41. The hub 50 rotates on the outer shaft 2*b*. The outer shaft 2*b* is axially coupled to the hub 50 so that the hub 50 rotates when the outer shaft 2*b* rotates. The axial coupling may be splining or serrating, for example.

The hub 50 may have a tubular connecting boss 51 at the center into which the outer shaft 2*b* is inserted. First irregularities such as splines or serrations may be formed on the outer circumference of the outer shaft 2*b*, and second irregularities 511 which mesh with the first irregularities may be formed on the inner circumference of the connecting boss 51. The outer shaft 2*b* may protrude upward from the hub 50 after passing through the connecting boss 51, and the protruding portion may be secured to a nut.

A clutch (not shown) may be provided to axially connect the inner shaft 2*a* and the outer shaft 2*b* or disconnect them. When the motor 6 rotates while the inner shaft 2*a* and the outer shaft 2*b* are axially connected by the clutch, the pulsator 5 and the inner tub 4 rotate together. By contrast, when the motor 6 rotates while the inner shaft 2*a* and the outer shaft 2*b* are axially disconnected, only the pulsator rotates 5 while the inner tub 4 is not rotating. There are already well-known types of clutches, so a detailed description thereof will be omitted.

Meanwhile, an epicyclic gear train (not shown) may be provided to convert the motor's torque into two outputs that rotate in opposite directions. In this case, when the pulsator 5 rotates (or when the pulsator 5 rotates while the inner shaft 2*a* and the outer shaft 2*b* are kept separated from each other by the clutch), the inner tub 4 rotates in the opposite direction from the pulsator 5. As compared to when only the pulsator 5 rotates while the inner tub 4 is not rotating, the speed of relative rotation of the pulsator 5 with respect to the inner tub 4 is higher, thereby forming a stronger centrifugal stream of water.

Referring to FIGS. 1 and 2, a circulating water jet device 70 may be provided which direct a centrifugal stream of water generated by the rotation of the pulsator 5 and/or inner tub 4 (or a water stream spreading out in a radial direction by centrifugal force) upward along the side of the inner tub 4 and then spray the upward-directed stream of water back on to the laundry in the inner tub 4.

The circulating water jet device 70 may include a circulating duct 73 for directing a centrifugal stream of water upward, and nozzles 74 for spraying the upward-directed stream of water back into the inner tub 4.

The inner tub 4 may include an inner tub base 41 attached to the hub 50 and a cylindrical drum 41 whose bottom is attached to the inner tub base 41. The inner tub base 41 may have a first opening 41*h* at the center, and a drain 41*a* spaced a predetermined distance apart from the first opening 41*h* in a radial direction to drain the centrifugal stream of water out of the inner tub 4.

The circulating duct 73 directs the water drained through the drain 41*a*. At least part of the circulating duct 73 is formed outside the inner tub 4. An insertion opening 41*b* may be formed on the inner tub base 41 through which the circulating duct 73 passes.

One end of the circulating duct 73 is connected to the drain 41*a* outside the inner tub 4 and inserted into the inner tub 4 through the insertion opening 41*b*, whereby a flow path for directing a stream of water upward is formed inside the inner tub 4. The nozzles 74 are connected to the other end of the circulating duct 73.

The circulating duct 73 may include a drainage duct 71 and an upward directing duct 72. The drainage duct 71 is attached to the inner tub 4, and forms a duct line outside the inner tub 4 through which the water drained through the drain 41*a* is directed. One end of the circulating duct 73 connects to the inside of the inner tub 4 through the drain 41*a*, and the other end of the circulating duct 73 connects to the upward directing duct 72. The nozzles 74 are connected to the upward directing duct 72.

The circulating water jet device 70 may include a filter for collecting lint floating in the stream of water. The filter may be provided in the circulating duct 73 or nozzles 74. When the pulsator rotates or the inner tub 4 rotates with the pulsator 5, a centrifugal stream of water spreading out in a radial direction is formed by centrifugal force. By properly controlling the speed of rotation of the motor 6, the stream of water directed upward along the circulating duct 73 may be filtered through the filter and then sprayed through the nozzles 74.

The upward directing duct 72 and/or nozzles 74 may be made detachable. In this case, the user may detach them and then remove lint collected by the first filter.

When the pulsator 5 rotates (in some embodiments, if an epicyclic gear train is provided, the inner tub 4 rotates in the opposite direction when the pulsator 5 rotates), a stream of water is formed that flows through the circulating duct 73 and is drained from the inner tub 4 through the through holes 42*h*. The stream of water drained through the through holes 42*h* is directed through the space between the inner tub 4 and the outer tub 3 and arrives at the bottom of the outer tub 3, and passes through the lower filter 60 to be described below and then flows back into the inner tub 4.

Referring to FIGS. 2, 3, and 8, the lower filter 60 may be placed under the hub 50. The lower filter 60 may include a filter frame 61 and a filter screen 62 is mounted on the filter frame 61.

The filter frame 61 has a shaft pass-through hole 61*a* at the center through which the outer shaft 2*b* passes and a plurality of water stream pass-through holes 61*b* around the circumference of the shaft pass-through hole 61*a*. The water stream pass-through holes 61*b* and the first opening 41*h* overlap. That is, as shown in FIG. 10, at least part of each water stream pass-through hole 61*b* may be formed in an area overlapping the first opening 41*h*.

The filter frame 61 may include a circular inner rim 611 defining the first opening 41*h*, a plurality of arms 612 extending from the inner rim 611 radially (or outward in a radial direction) and separating the water stream pass-through holes 61*b*, and a circular outer rim 613 interconnecting the outer edges of the arms 612.

Press-fit bosses 615 may be formed on the arms 612, and coupling projections 522 for fastening to the press-fit bosses 615 may be formed on the hub 50. The press-fit bosses 615 and the coupling projections 522 may be decoupled from each other, but with a coupling strength enough to decouple them by the user's force but not by a stream of water passing through the filter screen 62 when water is drained.

The filter screen 62 is fixed to the filter frame 61, and filters a stream of water passing through the water stream pass-through holes 61*b*. Impurities such as lint collected on the filter screen 62 are pumped out along with water when the pump 23 is run to drain water. For reference, although FIG. 3 illustrates that the filter screen 62 is mounted on only one of the water stream pass-through holes 61*b*, which means this drawing only lacks the filter screens mounted on the other water stream pass-through holes 61*b*, the filter screen 62 may be installed on all the water stream pass-through holes 61*b* as shown in FIG. 8.

Referring to FIGS. 4 to 7, the hub 50 includes a connecting boss 51 at the center connected to a dewatering shaft, a plurality of spokes 52 and 53 extending outward radially from the connecting boss 51, and a circular flange 55 connecting the outer edges of the spokes 52 and 53 and attached to the bottom of the inner tub 4.

The spokes 52 and 53 are arranged at regular intervals (preferably, at equal intervals) around the circumference, and second openings 50*h* are formed between each neighboring spoke 52 and 53. In an axial view, at least part of the second openings 50*h* and the first opening 41*h* overlap.

The hub 50 may be formed by aluminum alloy casting (preferably, die casting).

In particular, the casting aluminum alloys preferably include six ALDC types (classification according to KS specification number KS D 6006). The elements of the six ALDC types are tabulated in the following Table 1:

TABLE 1

| Chemical composition (%) | | | | | | | | |
|---|---|---|---|---|---|---|---|---|
| Cu | Si | Mg | Zn | Fe | Mn | Ni | Sh | Al |
| 0.1 or less | 1.0 or less | 2.6~4.0 | 0.4 or less | 0.8 or less | 0.1~0.6 | 0.1 or less | 0.1 or less | remainder |

Conventionally, the hub was cast from three ALDC types, and electrodeposition was performed for protection against corrosion. On the contrary, in the present invention, the hub is formed from six ALDC type materials which have higher corrosion resistance than the three ALDC types, thereby ensuring sufficient corrosion resistance without an electrodeposition process.

If one of the sides forming the exterior of the spokes 52 that faces the bottom of the outer tub 2 (specifically, the inner bottom surface of the outer tub 2) is defined as the underside, at least one of the spokes 52 has a smooth underside. That is, the underside of the first spokes 52 may be a surface with no irregularities or recesses, or a surface with a gradient represented by a given symbol (for example, a downward-sloping or upward-sloping surface), or a surface with a continuously changing gradient represented by a given symbol. Meanwhile, it is inevitable that fine irregularities are formed on the materials' surface in the casting process. These irregularities are caused by the roughness of the mold surface or the properties of the materials. Even with these irregularities, the first spokes 52 are defined as smooth unless they are designed intentionally with an irregular structure (especially, recesses) in mind. Preferably, the underside of the first spokes 52 is entirely a smooth surface.

In particular, irregularities less than 1 mm deep formed on the surface in the casting process will be viewed as smooth, as the recess depth should be no more than 1 mm.

In another aspect, a cross-section of the first spokes 52 may have a convex profile. That is, there is no concave portion in the profile, which leaves no room for build-up of lint.

Likewise, a cross-section of the second spokes 53 taken from areas other than recesses 521 may have a convex profile. A cross-section of the second spokes 53 has a convex profile even in the recesses 521, but not in the coupling projections 522.

In an exemplary embodiment, the hub 50 has a plurality of spokes 52 arranged at equal angle intervals (the hub 50 has 12 spokes in this exemplary embodiment, but not limited to it), and the first spokes 52 are arranged alternately around the circumference.

The underside of the first spokes 52 is a downward-facing surface with reference to FIG. 1, which faces the bottom of the outer tub 3. The underside may be either planar or curved. Since the underside of the first spokes 52 is flat without any irregularities, this prevents a build-up of impurities such as lint or dirt.

As described above, when a centrifugal stream of water is formed by the rotation of the pulsator 5 or inner tub 4, the stream of water passes through the through holes 42*h* of the inner tub 4 and arrives at the bottom of the outer tub 3, and passes through the lower filter 60 and the hub 50 and then flows back into the inner tub 4. If there are recesses on the underside of the first spokes 52, as in the conventional art, lint may build up in the recesses, because part of the stream of water flows between the lower filter 60 and the hub 50. To avoid this problem, in the present invention, the underside 525 of the first spokes 52 is formed as a smooth surface.

The first spokes 52 may further include a top side 524, an underside 525, and a first side 526 and second side 527 connecting the top side 524 and the underside 525. Preferably, the top side 524, the first side 526, and the second side 527 too have to be a surface with no irregularities, but not necessarily limited to this.

Meanwhile, positioning projections 529 may protrude from the top side 524 of the spokes 52 and 53. The inner tub base 41 may have positioning holes 41*c* corresponding in position to the positioning projections 529, into which the positioning projections 529 are inserted.

In order to increase the filtering effect through the circulating water jet device (i.e., the impurity collection performance through the filter), the flow rate of the water circulating through the circulating water jet device 70 should be high enough. The speed of rotation of the pulsator 5 may be raised first to increase the flow rate. This, however, may lead to an inevitable rise in power consumption and an increase in heat generation from the motor 6.

Moreover, there is a limit to the speed of rotation of the pulsator 5 when cleaning delicate clothes that wear out easily, because the pulsator 5 applies physical forces on laundry, such as agitating and rubbing.

One of the methods that provides a higher flow rate than in the conventional art without causing the aforementioned problems is to increase the area of the second openings 50*h* formed on the hub 50. In this regard, in the exemplary embodiment, assuming that the area of the first opening 41*h* is A1 and the area of the overlap portion between the second openings 50*h* and the first opening 41*h* is A2, Ar is 0.30 to 0.60 if Ar=A2/A1.

Figure 13:
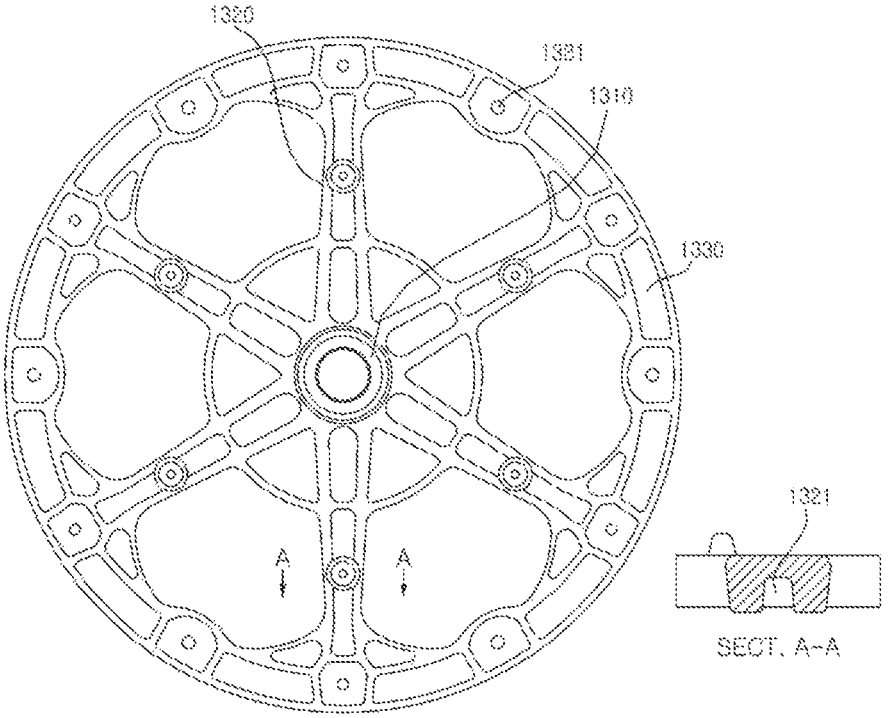
FIG. 13 shows a conventional hub, in which (a) shows the underside of the hub and (b) shows a cross-section of the hub taken along the line A-A shown in (a).

Specifically, if the diameter of the first opening 41*h* is 19.5 to 21.5 cm, the diameter of the hub 50 is 29.5 to 31.5 cm. Here, Ar is 0.50 to 0.60 (hereinafter, the hub 50 is referred to as having a first specification). In this case, assuming that the overall area of the hub 50 in the plan view is A3 and the overall area of the second openings 50*h* is A4, A4/A3 is 0.55 to 0.65. By contrast, in the conventional hub shown in FIG. 13, A4/A3 is only 0.46.

If the diameter of the first opening 41*h* is 23.0 to 25.0 cm, the diameter of the hub 50 is 35.5 to 36.5 cm. Here, Ar is 0.35 to 0.45. In this case, A4/A3 is 0.6 to 0.7 (hereinafter, the hub 50 is referred to as having a second specification). In this case, assuming that the overall area of the hub 50 in the plan view is A3 and the overall area of the second openings 50*h* is A4, A4/A3 is 0.55 to 0.65. By contrast, in the conventional hub shown in FIG. 13, A4/A3 is only 0.46. When the diameter of the first opening 41*h* and the diameter of the hub 50 are within these ranges, a hub in the conventional art has a 29.5% A4/A3, which shows a huge difference from the present invention.

In particular, the hub 50 in the present invention is made using a material with a higher stiffness than the conventional one, which ensures enough stiffness even if A4/A3 is increased compared to the conventional art. Accordingly, the weight of the hub may be reduced compared to the conventional hub.

Referring to FIG. 9, the first spokes 52 may have a cross-section 520 whose top side 524 is longer than the underside 525. Here, the cross-section 520 is perpendicular to the length of the first spokes 52. A cross-section 520 of the first spokes 520 may be a trapezoid whose top side 524 is longer than the underside 525 and whose vertices are chamfered into curves 528*a*, 528*b*, 528*c*, and 528*d*. In this case, as shown in FIG. 9, assuming that the distance between the top edge of the first side 526 and the top edge of the second side 527 which adjoin the curves 528*a* and 528*b* respectively is denoted by WU and the bottom edge of the first side 526 and the bottom edge of the second side 527 which adjoin the curves 528*c* and 528*d* respectively are denoted by WL, a hub with the first specification has a WU:WL ratio of 0.65 to 0.80 and a hub with the second specification has a WU:WL ratio of 0.40 to 0.55.

Meanwhile, cross-sections of the first spokes 52 are analogous to each other, and the areas of the cross-sections may become smaller toward the inside along the radius.

The spokes 52 may further include at least one second spoke 53. The second spoke 53 is basically the same shape as the first spokes 52, and further includes recesses 521 and coupling projections 522. That is, the second spoke 53 has substantially the same structure as the first spokes 52, except the recesses 521 and the coupling projections 522. Accordingly, the underside of the second spoke 53 is smooth in areas other than the recesses 521.

Specifically, the second spoke 53 may include recesses 521 from the underside and coupling projections 522 protruding from the bottom of the recesses 521.

The bottom of the recesses 521 may extend further in a circumferential direction than the portion located outside the recesses 521. By forming the recesses 521, the thinned portion of the second spoke 5 may be reinforced.

The coupling projections 522 are attached to the press-fit bosses 615 formed on the filter frame 61. The press-fit bosses 615 protrude upward. Accordingly, if no recesses 521 are formed in the second spoke 53 and the underside of the second spoke 53 is flat as is the first spokes 52 (that is, its surface has no irregularities as is the underside of the first spokes 52), the press-fit bosses 615 correspond to the protruding length, which leaves a gap between the hub 50 and the arms 612 of the filter frame 61. This increases the flow rate of the water that does not pass through the filter screen 62 but passes through the gap, thereby lowering the lint collection performance. To prevent this problem, the recesses 521 are formed on the underside of the second spoke, corresponding in position to the press-fit bosses 615.

Figure 12:
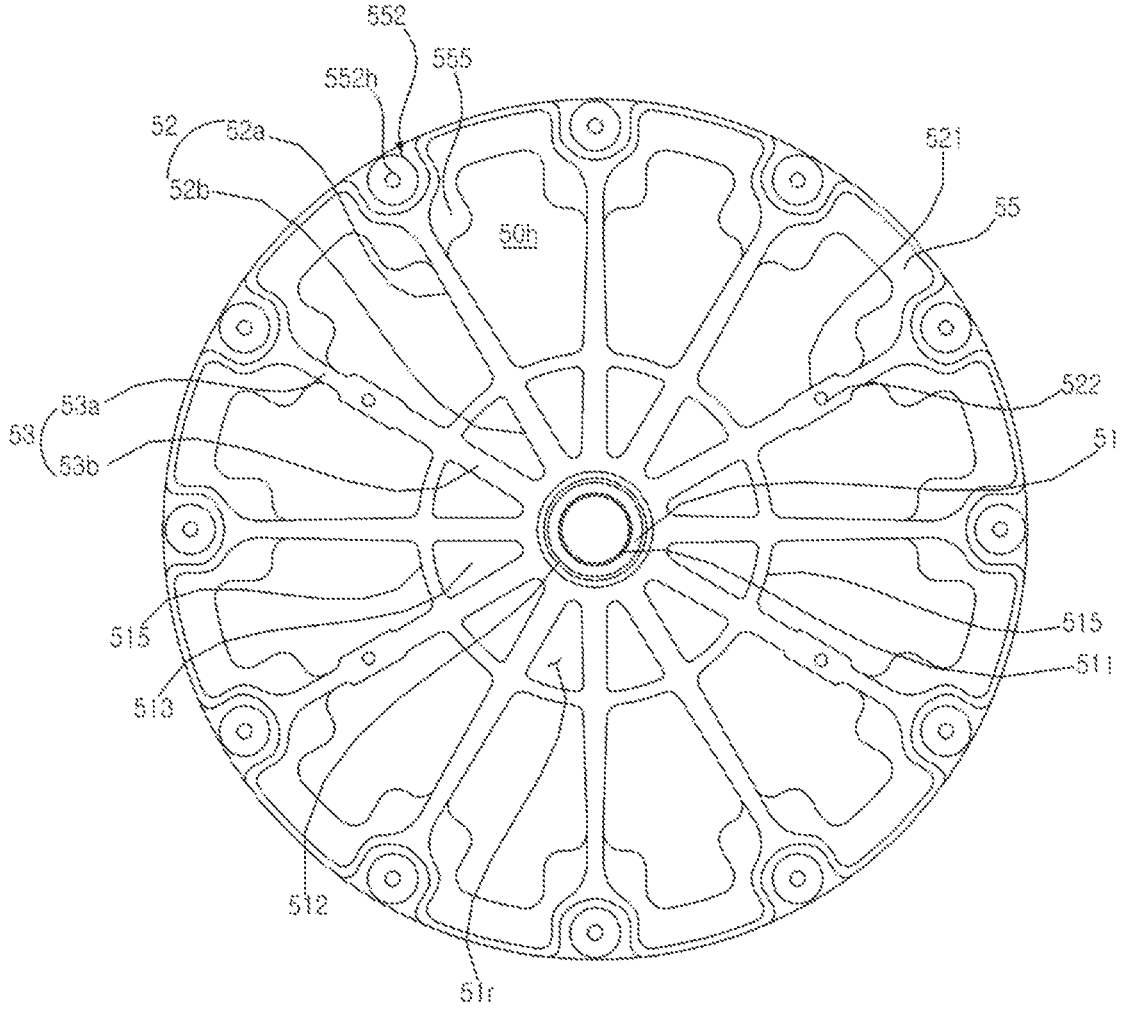
FIG. 12 shows the underside of a hub according to another exemplary embodiment of the present invention.

In some embodiments, a washing machine where the lower filter 60 is not employed may not have the second spoke 53, but instead all the spokes 52 and 53 may consist only of the first spokes 52 (see FIG. 12).

Meanwhile, the connecting boss 51 may include a cylindrical first portion 512 whose inner circumference engages with the dewatering shaft and a second portion 513 extending outward from the first portion 512 and connecting between the spokes 52 and 53.

Each spoke 52 and 53 may include outer portions 52*a* and 53*a* formed outside the connecting boss 51 and inner portions 52*b* and 53*b* protruding from the underside of the second portion 513. Due to this structure, arc-shaped grooves 51*r* are formed between the inner portions 52*b* and 52*b* of the second portion 513.

The connecting bosses 51 may further include circular ribs 515 protruding from the underside of the second portion 513 on the outer circumference of the second portion 513. The circular ribs 515 may form a single smooth surface along the underside of the spokes 52 and 53. That is, the underside of the circular ribs 515 and the underside of the spokes 52 and 53 may correspond in shape to form a single smooth surface.

The flange 55 may include a rim portion 551, a plurality of fastening bosses 552, and an outer circumferential rib 553. The rim portion 551 is approximately circular, and interconnects the spokes 52 and 53. The second openings **50*h* are defined by the rim portion 551, a pair of neighboring spokes 52 and 53, and the connecting boss 51**.

A plurality of fastening bosses 552 may be formed corresponding to the spokes 52 and 53. The fastening bosses 552 may protrude downward from the rim portion 551, and may be placed further outward than the spokes 52 and 53 around the circumference. The inner tub base 41 may have fastening holes 416 corresponding in position the fastening bosses 552. Fastening members (not shown) such as screws or bolts may be secured by passing through holes **552*h* formed in the fastening bosses 552 and the fastening holes 416, whereby the hub 50** may be mounted.

There may be a gap between each fastening boss 552 and each spoke 52. Specifically, the inner edges of the spokes 52 are connected to the connecting boss 51, and the outer edges are connected to the outer circumferential ribs 553 to be described later. In this case, the outer circumferential ribs 553 are connected to the outer edges of the spokes 52 within the gap between the outer edges of the spokes 52 and the rim portion 551.

That is, the outer circumferential ribs 552 may protrude from the underside of the rim portion 551, connect the outer edges of the spokes 52 together, extend along a given circumference, run inward from the circumference in the areas where the fastening bosses 552 are located, and be connected to the outer edges of the spokes 52 within the gap.

Figure 11:
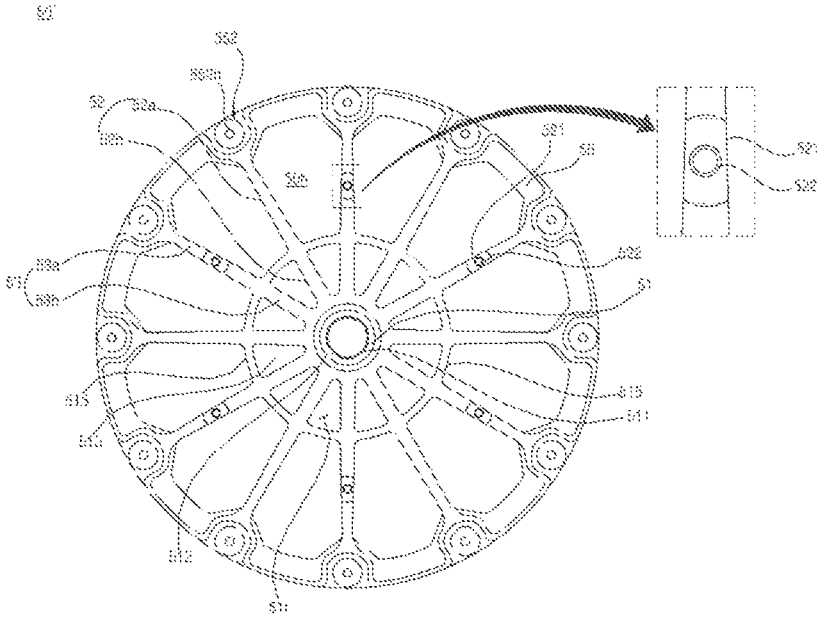
FIG. 11 shows the underside of the hub according to another exemplary embodiment of the present invention.

FIG. 11 shows the underside of the hub according to another exemplary embodiment of the present invention. In comparison with the hub 50 according to the foregoing exemplary embodiment, in a hub 50' according to this exemplary embodiment, the underside of the spokes 52 and 53 does not extend along the circumference even in the areas where the recesses are formed. Except this, the other components are substantially the same as the hub 50 according to the foregoing embodiment, so like components are denoted by like reference numerals and descriptions thereof will be omitted.

FIG. 12 shows the underside of a hub according to another exemplary embodiment of the present invention. In a hub 50" according to this exemplary embodiment, the underside of the spokes 52 is smooth in all areas where there are no recesses.

The flange 55 has an inward extension 555 along the circumference. The extension 555 may extend at least 0.5 cm from the outer edges of the spokes 52 and 53. Preferably, the extension 555 is formed on not all the spokes 52 and 53 but on every two spokes.

Except this, the other components are substantially the same as the hub 50 according to the foregoing exemplary embodiment, so like components are denoted by like reference numerals and descriptions thereof will be omitted.

A washing machine according to the present invention has the following advantages. First, the washing machine may improve sanitation by preventing a build up of impurities on the underside of a hub.

Second, the flow rate of water flowing into the inner tub through the openings formed in the hub may be increased. In particular, if a filter is provided which filters a stream of water passing through the openings and circulating between the inner tub and the outer tub, the filtering performance of the filter may be improved.

Third, the hub may be smaller in weight than the conventional art while maintaining enough stiffness.

Fourth, coating processes such as electrodeposition may be omitted because the hub is made using materials with high corrosion resistance. This gives benefits in terms of manufacturing and reduces the release of environmental contaminants.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

an outer tub configured to receive water;

an inner tub located within the outer tub and configured to rotate about a vertical axis, the inner tub defining a first opening at a bottom portion of the inner tub;

a motor configured to provide torque and configured to rotate the inner tub;

a dewatering shaft configured to be rotated by the motor; and a hub configured to support the inner tub from the bottom portion of the inner tub, the hub comprising:

a connecting boss that comprises a center portion configured to be connected to the dewatering shaft;

a plurality of spokes that extend radially outward from the connecting boss, and that are spaced apart by a plurality of second openings that overlap with at least a portion of the first opening of the inner tub; and a circular flange that connects outer edges of the plurality of spokes together, and that is attached to the bottom portion of the inner tub, wherein the plurality of spokes comprise one or more first spokes that each have a first bottom surface that faces the outer tub, and wherein the one or more first spokes define a cross-section having a top side that faces the inner tub and a bottom side that faces the outer tub, with a length of the top side being greater than a length of the bottom side.

2. The washing machine of claim 1, wherein the plurality of second openings of the hub overlap with the at least a portion of the first opening of the inner tub such that a ratio of a total area of overlapping portions with respect to an area of the first opening is in a range from 0.30 to 0.60.

3. The washing machine of claim 2, wherein a diameter of the first opening is in a range from 19.5 to 21.5 cm, wherein a diameter of the hub is in a range from 29.5 to 31.5 cm, and wherein the ratio of the total area of the overlapping portions with respect to the area of the first opening is in a range from 0.50 to 0.60.

4. The washing machine of claim 2, wherein a diameter of the first opening is in a range from 23.0 to 25.0 cm, wherein a diameter of the hub is in a range from 35.5 to 36.5 cm, and wherein the ratio of the total area of the overlapping portions with respect to the area of the first opening is in a range from 0.35 to 0.45.

5. The washing machine of claim 1, wherein the plurality of spokes further comprise one or more second spokes that each comprises:

a second bottom surface that defines a recess that is recessed toward the inner tub; and coupling projections that protrude from the recess toward the outer tub.

6. The washing machine of claim 5, wherein, for each of the one or more second spokes, a first portion of the second spoke around the recess extends further in a circumferential direction of the hub than at least one second portion of the second spoke other than the first portion.

7. The washing machine of claim 5, wherein the one or more first spokes and the one or more second spokes are arranged alternately along a circumference of the hub.

8. The washing machine of claim 5, wherein, for each of the one or more second spokes, (i) a first portion of the second spoke is arranged around the recess and (ii) at least one second portion of the second spoke, other than the first portion, has a cross-section having a convex shape.

9. The washing machine of claim 1, wherein the hub comprises:

a first hub portion that defines an inner circumference configured to engage with the dewatering shaft, the first hub portion having a cylindrical shape; and a second hub portion that extends radially outward from the first hub portion and that is disposed between the plurality of spokes, wherein each of the plurality of spokes comprises:

an outer spoke portion that is located radially outward of the connecting boss; and an inner spoke portion that is located radially inward of the connecting boss and that protrudes from a bottom side of the second hub portion.

10. The washing machine of claim 9, wherein the hub further comprises circular ribs that protrude from the bottom side of the second hub portion and that are arranged along an outer circumference of the second hub portion, and wherein the circular ribs define a plane corresponding to a bottom surface of the plurality of spokes.

11. The washing machine of claim 9, wherein the hub further comprises upper ribs that protrude from a top side of the second hub portion and that extend along a circumference outside the first hub portion of the hub.

12. The washing machine of claim 1, wherein the circular flange comprises:

a rim portion that connects the plurality of spokes; and a plurality of fastening bosses that are located radially outward of the plurality of spokes and that are spaced apart from the plurality of spokes by a gap; and outer circumferential ribs that protrude downward from a bottom side of the rim portion, that connect the outer edges of the plurality of spokes together, and that extend along a circumference of the hub, and wherein the outer circumferential ribs extend radially inward from positions of the circumference of the hub corresponding to the plurality of fastening bosses to connect to the outer edges of the plurality of spokes that are spaced apart by the gap from the plurality of fastening bosses.

13. The washing machine of claim 1, wherein a cross-sectional area of each of the one or more first spokes decreases along a radial direction toward the center portion of the connecting boss.

14. The washing machine of claim 1, further comprising:

a pulsator rotatably provided within the inner tub and configured to cause a stream of water based on rotating within the inner tub;

a circulating duct configured to guide the stream of water in an upward direction with respect to the bottom portion of the inner tub;

a duct filter located at the circulating duct and configured to filter substances from the stream of water; and nozzles arranged at an inside surface of the inner tub and configured to dispense the stream of water filtered by the duct filter into the inner tub.

15. The washing machine of claim 14, further comprising a hub filter located vertically below the hub and configured to filter substances from a flow of water that flows into the plurality of second openings that space apart the plurality of spokes based on rotation of the pulsator, wherein the hub filter comprises:

a filter frame that defines a plurality of through-holes through which the flow of water passes, the plurality of through-holes overlapping with the first opening of the inner tub; and a filter screen fixed to the filter frame and configured to filter substances from the flow of water passing through the through-holes.

16. The washing machine of claim 1, wherein a cross-section of the one or more first spokes has a convex shape.

17. The washing machine of claim 1, wherein the hub is made of six aluminum die casting (ALDC) type materials.

18. The washing machine of claim 1, wherein a surface roughness of the first bottom surface is less than or equal to 1 mm.

19. A washing machine comprising:

an outer tub configured to receive water;

an inner tub located within the outer tub and configured to rotate about a vertical axis, the inner tub defining a first opening at a bottom portion of the inner tub;

a motor configured to provide torque and configured to rotate the inner tub;

a dewatering shaft configured to be rotated by the motor; and a hub configured to support the inner tub from the bottom portion of the inner tub, the hub comprising:

a connecting boss that comprises a center portion configured to be connected to the dewatering shaft;

a plurality of spokes that extend radially outward from the connecting boss, and that are spaced apart by a plurality of second openings that overlap with at least a portion of the first opening of the inner tub; and a circular flange that connects outer edges of the plurality of spokes together, and that is attached to the bottom portion of the inner tub, wherein the plurality of spokes comprise one or more first spokes that each have a first bottom surface that faces the outer tub, and wherein the one or more first spokes have a trapezoid shape having a top side that faces the inner tub, a bottom side that faces the outer tub, and vertices that are chamfered in a curved shape, with a length of the top side being greater than a length of the bottom side.

20. The washing machine of claim 19, wherein the plurality of spokes further comprise one or more second spokes that each comprises:

a second bottom surface that defines a recess that is recessed toward the inner tub; and coupling projections that protrude from the recess toward the outer tub.

* * * * *